US010080930B2

(12) United States Patent
Goldwitz

(10) Patent No.: US 10,080,930 B2
(45) Date of Patent: Sep. 25, 2018

(54) STREET HOCKEY PUCK

(71) Applicant: Brian Goldwitz, New Haven, CT (US)

(72) Inventor: Brian Goldwitz, New Haven, CT (US)

(73) Assignee: Shelterlt, LLC, Waterbury, CT (US)

( * ) Notice: Subject to any disclaimer, the term of this patent is extended or adjusted under 35 U.S.C. 154(b) by 19 days.

(21) Appl. No.: 15/144,754

(22) Filed: May 2, 2016

(65) Prior Publication Data

US 2017/0312587 A1 Nov. 2, 2017

(51) Int. Cl.

| | |
|---|---|
| ***A63B 67/14*** | (2006.01) |
| ***A63B 43/00*** | (2006.01) |
| ***A63B 39/00*** | (2006.01) |
| ***A63B 69/00*** | (2006.01) |

(52) U.S. Cl.

CPC ..... *A63B 43/002* (2013.01); *A63B 39/00* (2013.01); *A63B 67/14* (2013.01); *A63B 69/0024* (2013.01); *A63B 2039/003* (2013.01)

(58) Field of Classification Search

CPC ..... A63B 49/002; A63B 39/00; A63B 67/14; A63B 43/002; A63B 69/0024; A63B 2039/003

See application file for complete search history.

(56) References Cited

U.S. PATENT DOCUMENTS 4,078,801 A * 3/1978 White, Sr. ..... A63B 67/14 473/588
4,153,253 A * 5/1979 White, Sr. ..... A63B 21/0603 40/327
4,183,536 A * 1/1980 Platt ..... A63B 67/14 273/DIG. 8
4,801,144 A 1/1989 De Masi, Jr. et al.
5,207,720 A * 5/1993 Shepherd ..... A63B 67/14 473/446
5,240,251 A * 8/1993 Filice ..... A63B 67/14 473/573
5,269,520 A 12/1993 Vellines
5,284,343 A * 2/1994 Bigornia ..... A63B 21/0603 473/446
5,429,360 A 7/1995 Capecci, Jr.
5,518,237 A * 5/1996 Bellehumeur ..... A63B 21/0603 473/588

(Continued)

FOREIGN PATENT DOCUMENTS

| | | |
|---|---|---|
| CA | 2834148 A1 | 2/2015 |
| CA | 2892569 A1 | 11/2015 |
| WO | 2005/030339 A2 | 4/2005 |

OTHER PUBLICATIONS

International Search Report & Written Opinion for PCT/US 2017/030680 dated Aug. 31, 2017; 5 pages.

*Primary Examiner* — Raleigh W Chiu

(74) *Attorney, Agent, or Firm* — Loza & Loza, LLP; Julio Loza; Tyler Barrett

(57) ABSTRACT

A puck includes a main body having a first portion and a second portion securely attached to form a generally cylindrical shape with an internal cavity. One or more energy absorbing components are positioned within the internal cavity. A weight component is positioned adjacent to the one or more energy absorbing components within the internal cavity. The weight component is sized to move in a vertical direction and deform the one or more energy absorbing components within the internal cavity in response to movement of the puck.

20 Claims, 8 Drawing Sheets

(56) References Cited

U.S. PATENT DOCUMENTS

| | | | | | |
|---|---|---|---|---|---|
| 5,518,238 | A | | 5/1996 | Hu et al. | |
| 5,733,213 | A | * | 3/1998 | Colarusso | A63B 67/14 473/588 |
| 5,792,012 | A | * | 8/1998 | Dudley | A63B 67/14 473/588 |
| 5,855,528 | A | * | 1/1999 | Aiello | A63B 67/14 473/588 |
| 5,928,096 | A | * | 7/1999 | Boardman | A63B 67/14 473/588 |
| 5,976,042 | A | * | 11/1999 | LaMarche | A63B 67/14 473/588 |
| 6,089,998 | A | * | 7/2000 | O'Neal | A63B 67/14 473/588 |
| 6,146,293 | A | * | 11/2000 | Chinn | A63B 67/14 473/588 |
| 6,248,034 | B1 | * | 6/2001 | Voloshen | A63B 67/14 473/588 |
| 2004/0235594 | A1 | * | 11/2004 | Pencer | A63B 67/14 473/588 |
| 2005/0064967 | A1 | * | 3/2005 | Coleman | A63B 67/14 473/588 |
| 2006/0128509 | A1 | * | 6/2006 | Poruchny | A63B 67/14 473/588 |
| 2015/0057116 | A1 | * | 2/2015 | Pederson | A63B 67/14 473/588 |
| 2016/0332052 | A1 | * | 11/2016 | Bauman | A63B 67/14 |

* cited by examiner

STREET HOCKEY PUCK

FIELD

This application relates to a hockey puck and in particular to a street or roller hockey puck for use on asphalt, concrete, or other type of non-ice playing surfaces.

BACKGROUND

The sport of street or roller hockey has increased in popularity due to the advent of roller blade or in-line skates. Street hockey is played on asphalt, concrete, hardwood or other non-ice playing surface, such as on streets, parking lots and outdoor play areas at schools and skate parks. Such playing surfaces are often rough, unlike ice hockey, and may have dirt, rocks or other debris. Conventional hockey pucks designed for play on ice or smooth surfaces perform very erratically on these rough playing surfaces. The rough playing surfaces tend to cause conventional hockey pucks to bounce, flip or roll on their outer edges rather than to smoothly glide. Stick handling, such as moving the puck side to side with the stick, is difficult when the puck does not stay flat on the playing surface.

One type of hockey puck referred to as a "street hockey puck" is designed for use on these rough playing surfaces. In particular, one example is a hockey puck as defined under U.S. Pat. No. 5,792,012 by Dudley. The hockey puck under Dudley may still tend to bounce, flip or roll on its outer edges rather than to smoothly glide. Thus, there is a need for an improved street hockey puck.

SUMMARY

According to a first aspect, a main body has a generally cylindrical shape and forms an internal cavity. A weight component is positioned within the internal cavity, wherein the weight component has a substantial mass density. One or more energy absorbing components are positioned between the weight component and the main body within the internal cavity.

According to a second aspect, the weight component is sized to move in a vertical direction and deform the one or more energy absorbing components within the internal cavity in response to movement of the puck.

According to a third aspect, the weight component includes a disc-shaped component sized to extend across a majority of the internal cavity, wherein the internal cavity has a diameter that is at least half the diameter of the puck.

According to a fourth aspect, the weight component has a weight that is at least 25% or more than the total weight of the puck.

DETAILED DESCRIPTION

The word "exemplary" or "embodiment" is used herein to mean "serving as an example, instance, or illustration." Any implementation or aspect described herein as "exemplary" or as an "embodiment" is not necessarily to be construed as preferred or advantageous over other aspects of the disclosure. Likewise, the term "aspects" does not require that all aspects of the disclosure include the discussed feature, advantage, or mode of operation.

Embodiments will now be described in detail with reference to the accompanying drawings. In the following description, numerous specific details are set forth in order to provide a thorough understanding of the aspects described herein. It will be apparent, however, to one skilled in the art, that these and other aspects may be practiced without some or all of these specific details. In addition, well known steps in a method of a process may be omitted from flow diagrams presented herein in order not to obscure the aspects of the disclosure. Similarly, well known components in a device may be omitted from figures and descriptions thereof presented herein in order not to obscure the aspects of the disclosure.

Overview

In an exemplary embodiment, a puck includes a main body having a first portion and a second portion securely attached to form a generally cylindrical shape with an internal cavity. One or more energy absorbing components are positioned within the internal cavity. A weight component is positioned adjacent to the one or more energy absorbing components within the internal cavity. The weight component is sized to move in a vertical direction and deform the one or more energy absorbing components within the internal cavity in response to movement of the puck. The presence of the weight component helps to prevent the puck from bouncing and to remain horizontal along the ground. The energy absorbing components help to absorb or cushion movements of the weight component within the internal cavity.

First Embodiment

Figure 1A:
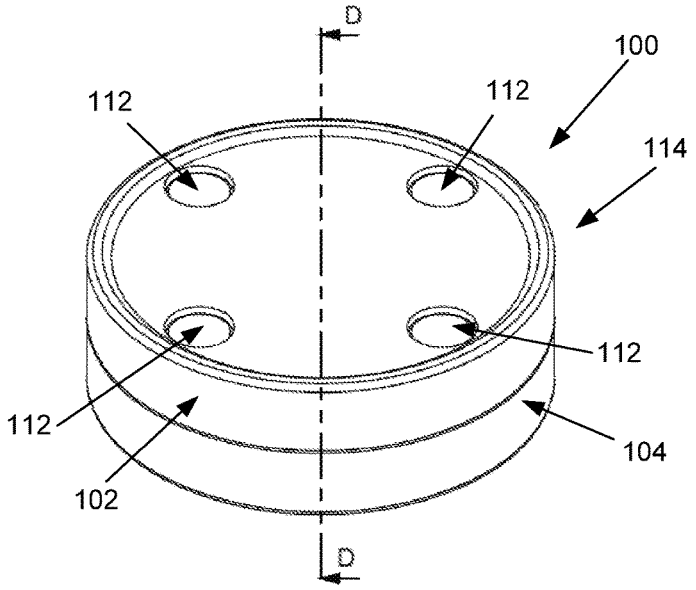
FIG. 1A illustrates an elevational view of an exemplary embodiment of a puck.

FIG. 1A illustrates an elevational view of an exemplary embodiment of a puck 100. The puck 100 may be used for street or roller hockey or may be used for other sports or activities. The puck 100 may have a similar or same size as an ice hockey puck, e.g. approximately three inches or 75 mm in diameter by one inch or 25 mm in height. In other embodiments, the puck 100 may have other sizes, e.g. a larger size for a practice puck or a smaller size for junior players.

In an embodiment, the puck 100 includes a main body 114 that is generally cylindrical in shape and includes a first portion 102 and a second portion 104. The first portion 102 and the second portion 104 are generally cylindrical shaped halves and have a similar size and shape. The first portion 102 and the second portion 104 are securely attached by one or more fasteners 112. In an embodiment, the one or more fasteners 112 are each a rigid pin, such as a plastic or metallic rivet, which extends through the first portion 102 and the second portion 104 as shown in more detail herein. The one or more fasteners 112 securely attach the first portion 102 and the second portion 104 together, e.g. to prevent radial, horizontal and vertical movement and axial rotation relative to each other. The material for the main body 114 is selected to achieve a desired combination of flexibility, firmness, and resilience and may include, e.g. a natural or synthetic polymer, such as plastic, silicone, rubber, etc.

Figure 1B:
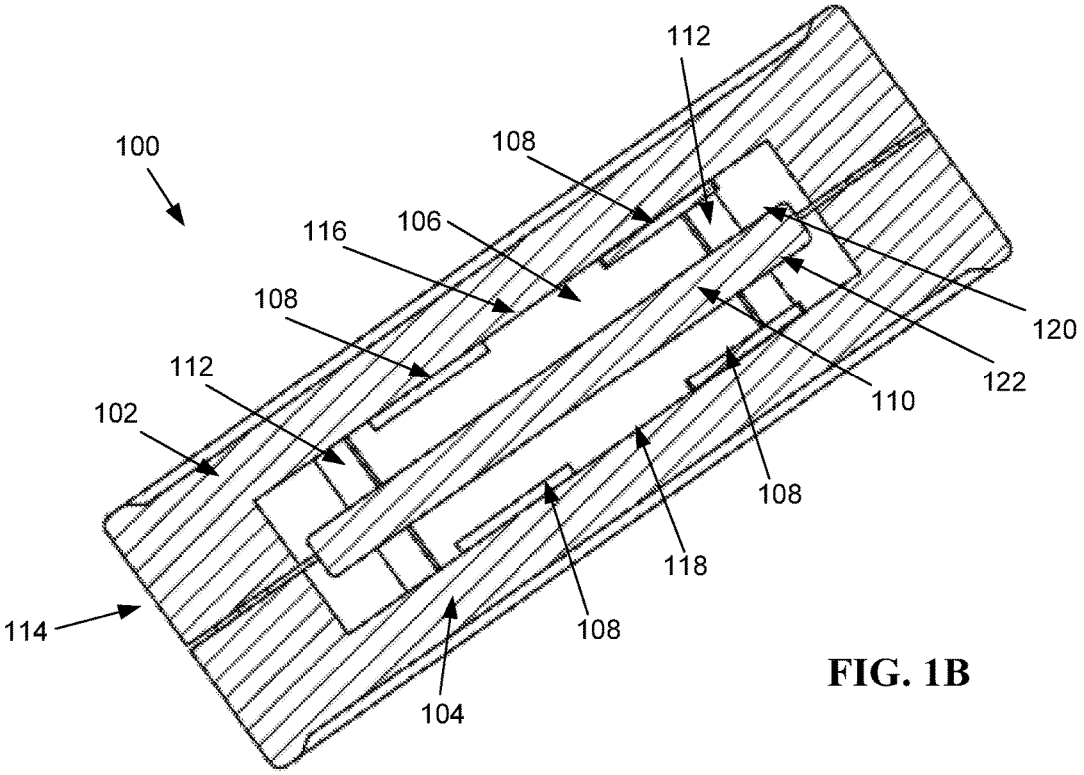
FIG. 1B illustrates a cross-sectional side view of an exemplary embodiment of the puck.

FIG. 1B illustrates a cross-sectional view of an exemplary embodiment of the puck 100. The cross-sectional view is shown along line D in FIG. 1A. The first portion 102 and the second portion 104 of the main body 114 form an internal cavity 106. In one aspect, a weight component 110 is sized and shaped to fit within the internal cavity 106. The weight component 110 has a substantial mass density. For example, the weight component has a mass density of typical metals or alloys, substantially greater than the density of the material of the main body 114, such as a polymer. For example, the weight component 110 may have a mass density that is approximately 10 times or greater than the mass density of the material of the main body 114. In one embodiment, the weighted component 110 may comprise a metallic or alloy substance, e.g. having a mass density of approximately 2000-10000 kg/m3, while the first portion 102 and the second portion 104 comprise a plastic, silicone, rubber or other polymer type material, e.g. having a mass density of 0.5-4 g/cm3.

The presence of the weight component 110 in the internal cavity 108 generates a downward force on the puck 100. This force helps to prevent the puck 100 from bouncing and to remain horizontal along the ground, e.g. when a player hits a slap shot or when tossed to the playing surface.

One or more energy absorbing components 108 are positioned between the weight component 110 and the main body 114. For example, one or more energy absorbing components 108 may be positioned within the internal cavity between the first portion 102 and the weight component 110. In addition, one or more energy absorbing components 108 may be positioned between the second portion 104 and the weight component 110. The weight component 110 and energy absorbing components 108 may be sized and shaped to be positioned adjacently within the internal cavity 106. The energy absorbing components 108 may be attached to an internal side 116 of the first portion 102 or may be attached to an internal side 118 of the second portion 104. Alternatively or in addition, the energy absorbing components 108 may be attached to a first side 120 of the weight component 110 or may be attached to a second side 118 of the weight component 110. In another aspect, the energy absorbing components 108 may also be attached to a perimeter of the weight component 110 and/or internal side walls of the internal cavity 106.

In an embodiment, the energy absorbing components 108 may include one or more of rubber, foam, springs, honeycomb, or other material having a shape or property to absorb energy due to impact or movement of the weight component 110 within the internal cavity 106. The weight component 110 is sized to move in a vertical direction within the internal cavity 106 and to deform the one or more energy absorbing components 108 within the internal cavity 106 in response to movement of the puck 100. In another embodiment, the weight component 110 is sized to move or tilt in a vertical and/or horizontal direction and deform the one or more energy absorbing components 108 within the internal cavity 106 in response to movement of the puck. The energy absorbing components 108 help to absorb or cushion the energy generated by impacts from the weight component 110 due to rough playing surfaces, such as asphalt, concrete, and the like, thus increasing the likelihood that the puck 100 maintains a horizontal position with respect to a playing surface as it slides across the same. In addition, the downward force generated by the weight component 110 lessens bouncing or bounce height by the puck 100.

Figure 2:
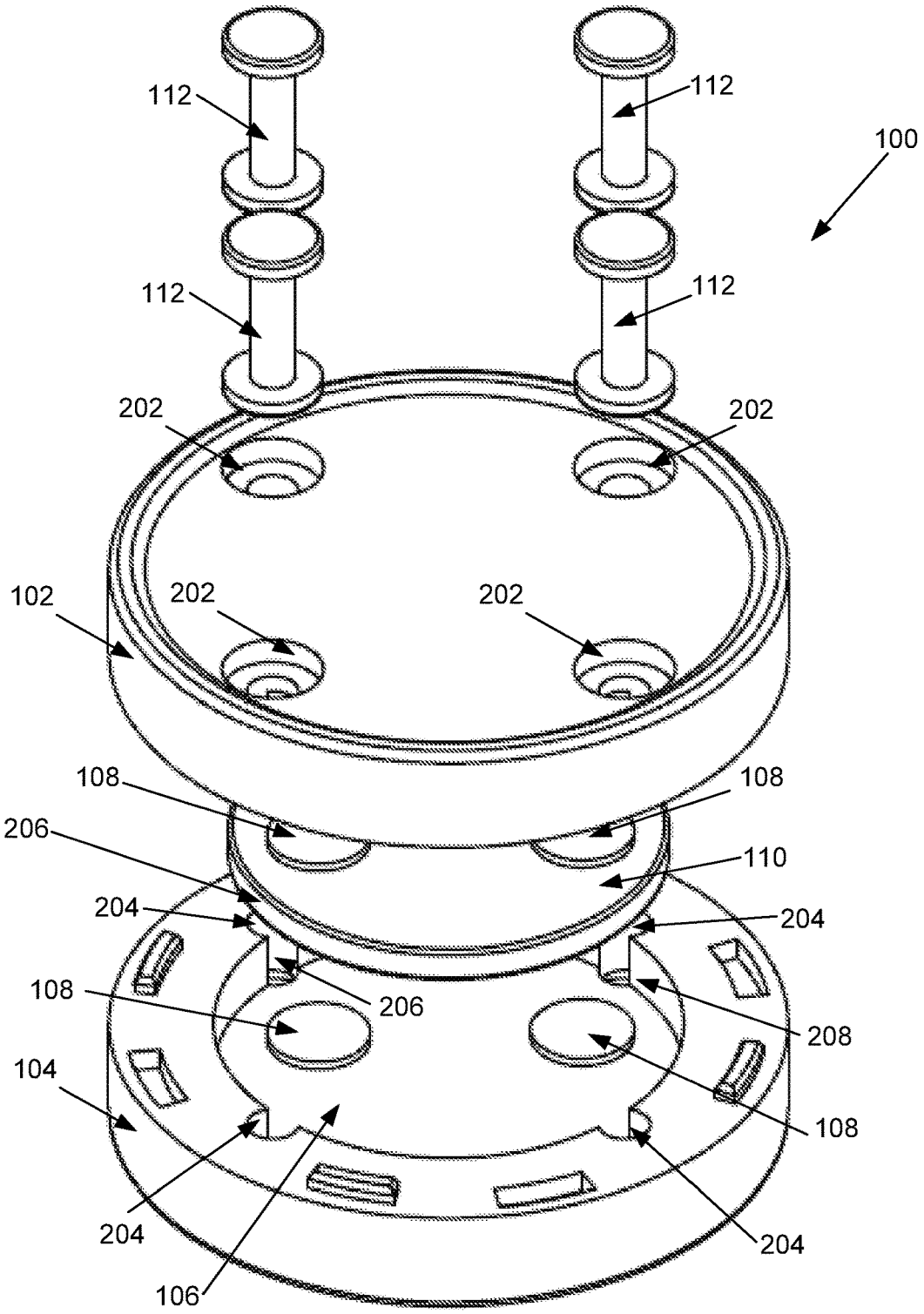
FIG. 2 illustrates an elevational view of an exemplary embodiment of components of the puck.

FIG. 2 illustrates an elevational view of an exemplary embodiment of components of the puck 100. In an embodiment, the puck 100 includes one or more fasteners 112. In an embodiment, the one or more fasteners 112 include a rivet or similar type fastener. The rivets extend through first openings 202 formed in the first portion 102 and through second openings 204 formed in the second portion 104. Though four fasteners 112 are illustrated, a varied number of more or less fasteners may be implemented to secure the main body 114. For example, two, three or five or more fasteners 112 may be implemented instead. In addition, though the fasteners 112 are installed at the periphery of the first portion 102 and the second portion 104, one or more fasteners 112 may be installed centrally to the puck 100 and extend through an opening in the weight component 110 (not shown) as well as through the first portion 102 and the second portion 104.

Though fasteners 112 are illustrated, other means or methods may be implemented to securely attach the first portion 102 and the second portion 104. For example, an adhesive may be used to securely attach the first portion 102 and the second portion 104.

The weight component 110 in one aspect includes a single disc-shaped weight sized to extend across a majority of the internal cavity 106. For example, the diameter of the disc shaped weight component 110 is slightly less than the diameter of the internal cavity 106. In one embodiment, the diameter of the internal cavity 106 is approximately 50.5 mm while the diameter of the disc shaped weight component 110 is 50 mm. Thus, the disc shaped weight component 110 has a diameter that is approximately 0.1% to 5% less than the diameter of the internal cavity 106. In other embodiments, the weight component 110 may include other shapes or number of weights within the internal cavity 106.

In an embodiment, energy absorbing material 108 may be attached to the outer perimeter 206 of the weight component 110. For example, a band of rubber, foam, or other such material may be attached to the perimeter 206 of the weight component 110. The energy absorbing material 108 on the perimeter 206 of the weight component 110 helps to absorb or cushion bumps from rough playing surfaces, such as asphalt, concrete, and the like. This also decreases the likelihood of cracks or breaking of the fasteners or main body 114 of the puck 100 from any horizontal impact or movement of the weight component 110 within the internal cavity 106. Alternatively or in addition to the perimeter 206 of the weight component 110, energy absorbing material 108 may be attached to the exposed portions of the fasteners 112 within the internal cavity 106 and/or the inner side walls 208 of the internal cavity 106.

The energy absorbing material 108 is shown in FIG. 2 as two first discs between the weight component 110 and the first portion 102 and as two second discs positioned between the weight component 100 and the second portion 104. In other embodiments, the energy absorbing material 108 may include a single disc between the weight component 110 and the first portion 102 that has a diameter approximately equal to or less than the weight component 110 and as a second disc positioned between the weight component 110 and the second portion 104 with a diameter approximately equal to or less than the weight component 110. In another aspect, the energy absorbing material 108 may include three or more discs between the weight component 110 and the first portion 102 and three or more discs positioned between the weight component 110 and the second portion 104 with a diameter approximately equal to or less than the weight component 110. In other embodiments, the energy absorbing material 108 may include a one or more component pieces of alternate shapes, such as cubes, etc.

In an embodiment, the first openings 202 formed in the first portion 102 and the second openings 204 formed in the second portion 104 include partial to semi-circular walls configured to expose a portion of the fasteners 112 to the internal cavity 106. In one aspect, the exposed portions of the fasteners 112 protrude into the internal cavity 106. In an embodiment, the fasteners 112 comprise a metal or alloy material or other material sufficiently hard to withstand impacts of the weight component 110. The weight component 110 is sized and shaped such that an outer perimeter 206 of the weight component 110 impacts the exposed portions of the fasteners 112 rather than the inner side walls 208 of the internal cavity 106. For example, the weight component 110 is disc shaped with size to include a small space between the fasteners 112 and the weight component 110 within the internal cavity 106. The weight component 110 moves horizontally and vertically within the internal cavity 106 and impacts the exposed portions of the fasteners 112 within the internal cavity 106 rather than the inner side walls 208. In an embodiment, the exposed portions of the fasteners 112 are metallic and protect the plastic inner side walls 108 from impacts of the weight component 110.

In another embodiment, the weight component 110 is sized to securely abut the exposed portions of the fasteners 112. The fasteners 112 help to secure the weight component 110 within the internal cavity 106 and prevent horizontal movement of the weight component 110 within the internal cavity 106. The weight component 110 moves in a vertical direction to deform the one or more energy absorbing components 108.

Figure 3:
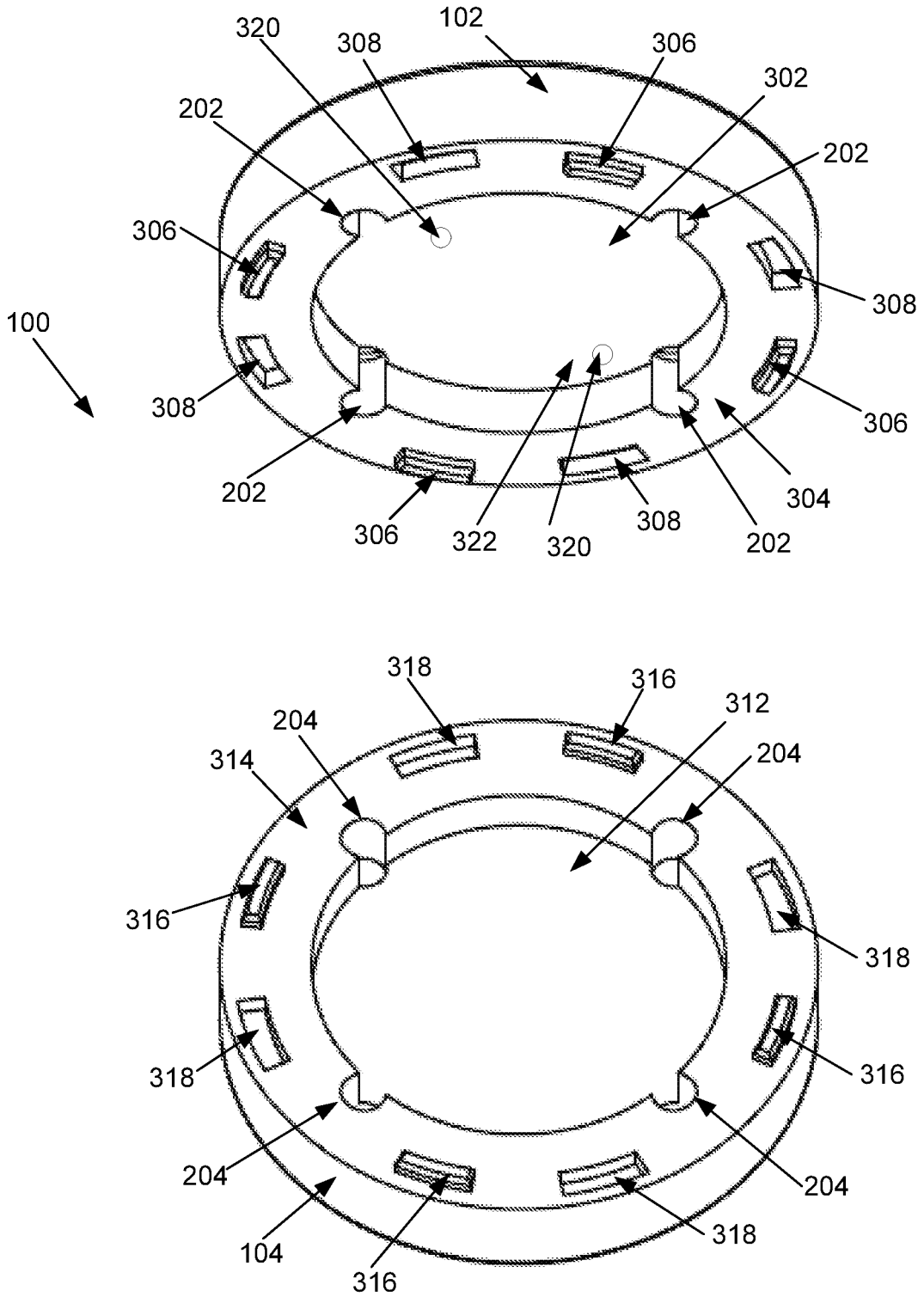
FIG. 3 illustrates an elevational view of an exemplary embodiment of a first portion and a second portion of the puck.

FIG. 3 illustrates an elevational view of an exemplary embodiment of the first portion 102 and the second portion 104 of the puck 100. The first portion 102 includes a first peripheral wall 304 that forms a first cavity 302. Similarly, the second portion 104 includes a second peripheral wall 314 that forms a second cavity 312. The first portion 102 and the second portion 104 are attached to form the main body 104, e.g. by the one or more fasteners 112. When attached, the first cavity 302 of the first portion 102 and the second cavity 312 of the second portion 104 form the internal cavity 106. Though two portions are described herein, the main body 114 of the puck 100 may be formed by a various number of portions or components, such as three or more portions. In addition, the internal cavity 106 is shown as cylindrical shaped but may have different shapes, such as rectangular, cubed, etc.

In an embodiment, one or more first protrusions 306 extend from the first peripheral wall 304 and are formed by or attached to the first peripheral wall 304 of the first portion 102. The first protrusions 306 are shaped to fit within corresponding openings or slots 318 formed in the second peripheral wall 314 of the second portion 104. In addition or alternatively, on the second portion 104, one or more second protrusions 316 extend from and are formed by or attached to the second peripheral wall 314. The second protrusions 316 are shaped to fit within corresponding openings or slots 308 formed in the first peripheral wall 304 of the first portion 304.

When the first portion 102 and the second portion 104 are attached, the protrusions 306, 316 fit within the corresponding slots 308, 318. This helps to to secure the main body 114 of the hockey puck and prevent radial and horizontal movement and axial rotation between the first portion 102 and the second portion 104. It also helps with correct alignment of the top portion 102 and the second portion 104.

In another aspect, the protrusions 306, 316 have a length greater than a depth of the corresponding slots 308, 318. When the first portion 102 and the second portion 104 are attached, the longer protrusions 306, 316 create a slit (shown in FIG. 5) between the first portion 102 and the second portion 104. For example, the protrusions 306, 316 may have a length approximately 3.2 mm or ⅛ inch greater than the depth of the corresponding slots 308, 318 creating a 3.2 mm slit or space between the first portion 102 and the second portion 104. The slit allows any water or debris that may get into the internal cavity 106 to drain or escape from the internal cavity 106 of the puck 100.

In another aspect, the top portion 102 and/or the second portion 104 may form one or more weep holes 320 from an exterior to the internal cavity 106. For example, a top surface 322 of the first portion 102 may form a weep hole 320. The one or more weep holes 320 may also be formed in the second portion 104. The one or more weep holes 320 allow any water or debris that may get into the internal cavity 106 to drain or escape from the internal cavity 106 of the puck 100.

Figure 4:
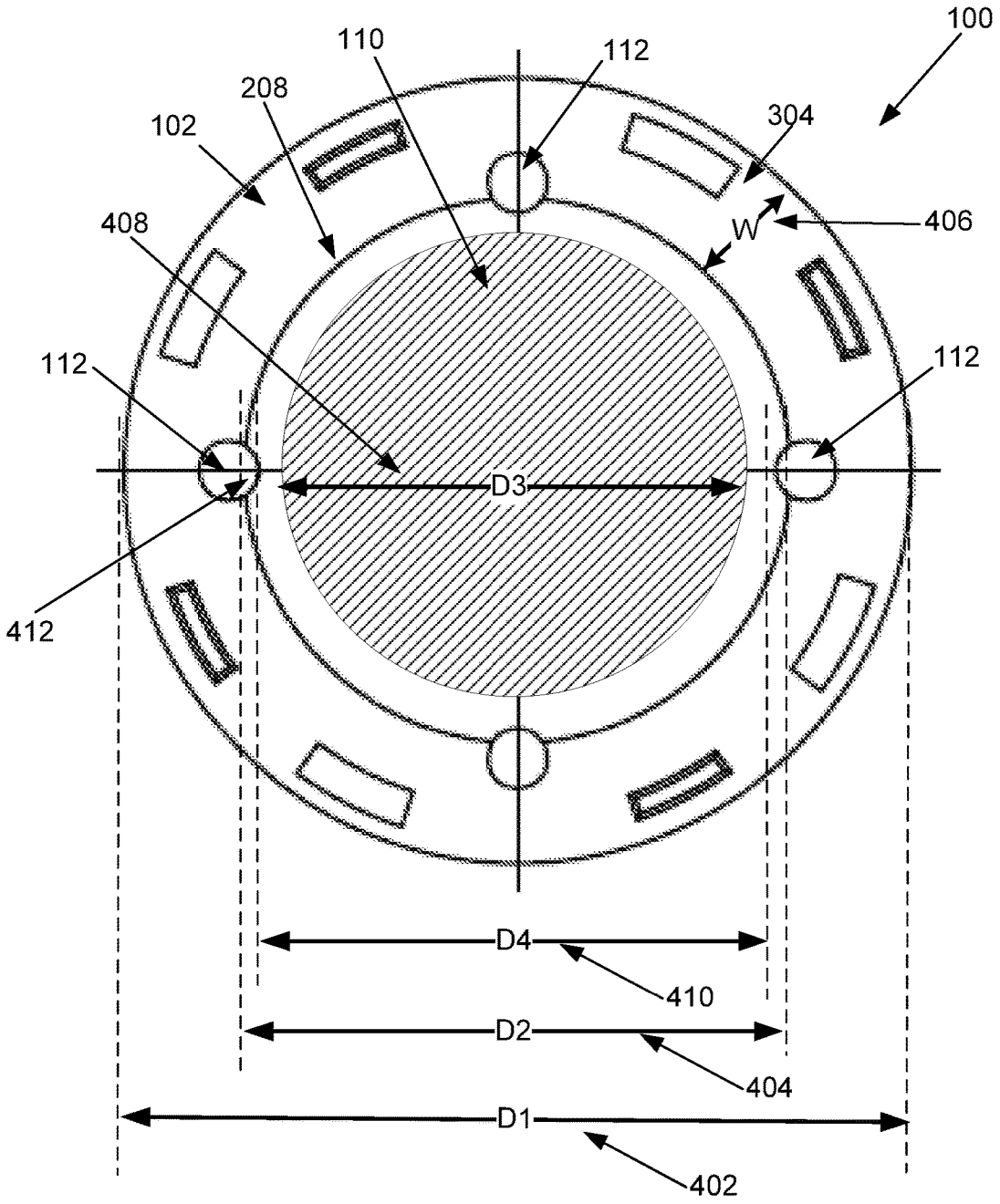
FIG. 4 illustrates a top view of an exemplary embodiment of a first portion of the puck.

FIG. 4 illustrates a top view of an exemplary embodiment of the first portion 102 of the puck 100. Though the first portion 102 is shown, the second portion 104 may have similar dimensions as described herein. In one aspect, the puck 100 has a diameter D1 402 equal to standard or regulatory ice hockey puck dimensions, e.g. approximately 3 inches or 75 mm. The peripheral wall 304 has a width W 406 that is approximately 12 mm. The internal cavity 110 has a diameter D2 404 that is approximately 50.5 mm. Thus, in an embodiment, the internal cavity 106 has a diameter D2 that is at least or more than half the diameter D1 of the puck 100. For example, the diameter D2 of the internal cavity 106 may be at least ⅔ or more of the diameter D1 of the puck 100.

The internal cavity 106 may have other shapes than the cylindrical shape shown in FIG. 4. For example, the internal cavity 106 may be rectangular, cubed, etc. In one or more aspects, the volume of the internal cavity 106 is at least 20% to 25% of the volume of the puck 100.

To properly compensate for impacts from rough playing surfaces, the width or diameter D3 of the weight component 112 should extend over at least half or 50% of the width or diameter D1 of the puck 100. For example, when the diameter D1 402 of the puck 100 is approximately 75 mm, the diameter D2 of the internal cavity 106 is approximately 50.5 mm while the diameter D3 of the weight component 110 is approximately 50 mm. Thus, the weight component 110 has a diameter or width that extends over at least half or 50% of the width or diameter D1 of the puck 100

In an embodiment, the width or diameter D3 of the weight component 112 is slightly less than, e.g. approximately 0.1% to 5% less than, the diameter of the internal cavity 108. In another embodiment, the weight component 110 has a diameter or width that is slightly less than, e.g. approximately 0.1% to 5% less than, the distance D4 410 between exposed portions 412 of the fasteners 112. The weight component 110 may then move between the exposed portions 412 of the fasteners 112 within the internal cavity 106 and impact the exposed portions 412 of the fasteners 112 rather than the inner side wall 208 of the internal cavity 106.

In other embodiments, the weight component 108 has a diameter or width D3 that is approximately equal to the distance D4 410 between exposed portions 412 of the fasteners 112. The weight component 108 then securely abuts the exposed portions 412 of the fasteners 112 within the internal cavity 106 such that horizontal movement is prevented.

The weight component 110 has a substantial weight with respect to the total weight of the puck 100. In one aspect, the weight component 110 has a weight that is at least 25% or more than the total weight of the puck 100. In another aspect, the weight component 110 has a weight that is approximately 50% of the total weight of the puck 100 (e.g. between 45-55%). In another aspect, the weight component 110 has a weight that is more than 50% of the total weight of the puck. For example, when the puck 100 has a total weight of 5-6 ounces, the weight component 110 may have a weight of 2.5-3 ounces out of the 5-6 ounces. The weight component 110 may have a weight greater than 3 ounces, e.g., when the puck 100 weighs 5-6 ounces.

Figure 5:
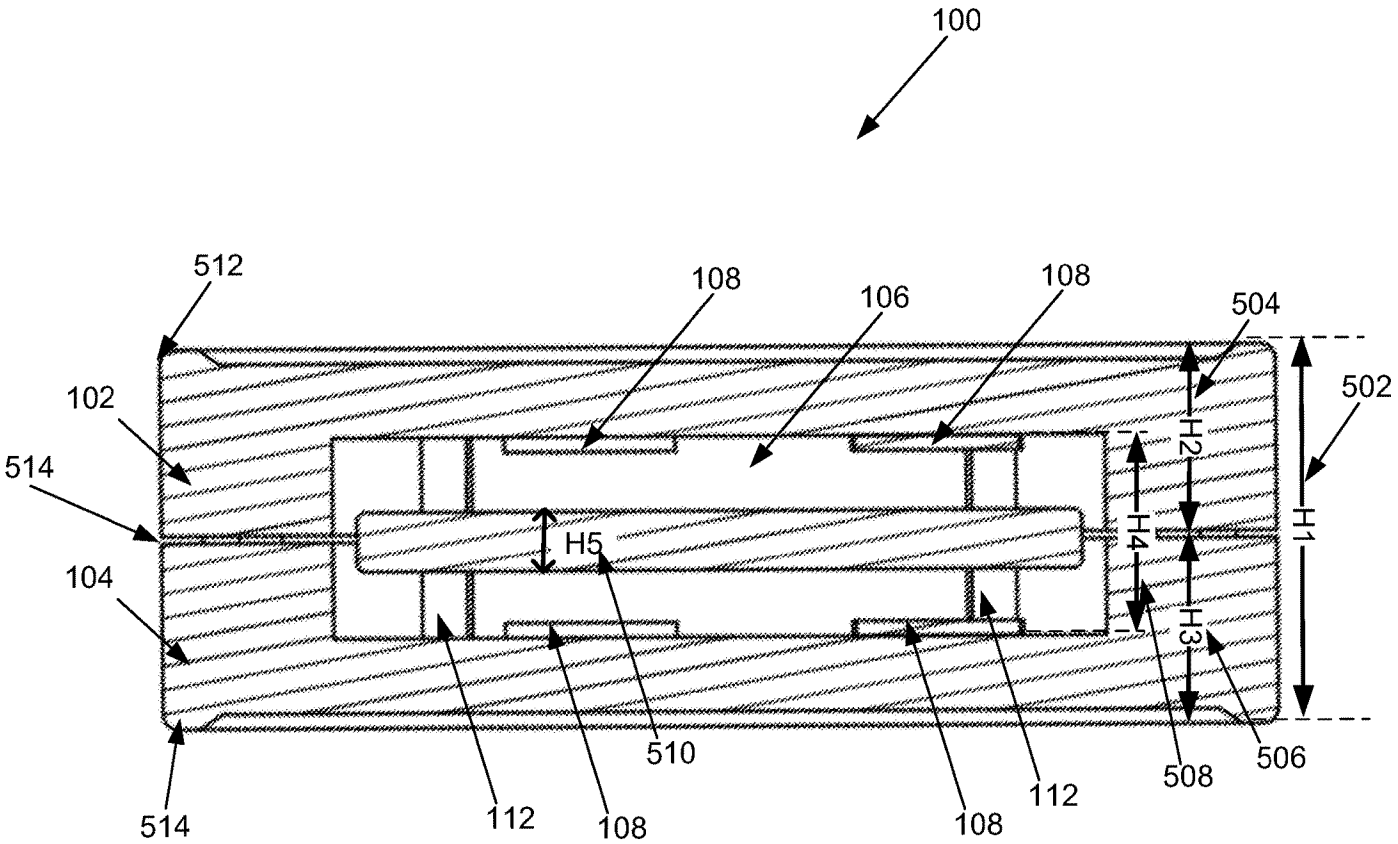
FIG. 5 illustrates a cross-sectional side view of an exemplary embodiment of the puck with illustrative dimensions.

FIG. 5 illustrates a cross-sectional side view of an exemplary embodiment of the puck 100 with illustrative dimensions. In one aspect, the puck 100 has a regulation height H1 502 of approximately 1 inch or 25 mm. The height H2 504 of the first portion 102 is 12.5 mm and similarly, the height H3 506 of the second portion 104 is also 12.5 mm. The internal cavity 106 has a height that is approximately 14 mm. In an embodiment, the height of the internal cavity 106 is at least 50% of the height of the puck 100. The internal cavity 106 may have other sizes and shapes as well. In another aspect, the height H2 of the first portion 104 may be more or less than the height H3 of the second portion 104.

In an embodiment, the main body 114 may form a slit 512 between the first portion 102 and the second portion 104. For example, the protrusions 306, 316 may have a length approximately 3.2 mm or ⅛ inch greater than the depth of the corresponding slots 308, 318 creating a 3.2 mm slit 512 or space between the first portion 102 and the second portion 104. The slit 512 allows any water or debris that may get into the internal cavity 106 to drain or escape from the internal cavity 106 of the puck 100.

The weight component 110 has a height H5 510 that is less than the height H4 of the internal cavity 110 such that the weight component 110 may move vertically within the internal cavity 106. In an embodiment, the weight component 110 may abut the energy absorbing components 108 such that the weight component 110 deforms the energy absorbing component 108 in response to bumps or movements of the puck 100. The weight component 110 may be sized to abut the one or more fasteners 112. The one or more fasteners 112 may prevent horizontal movement of the puck within the internal cavity 106. In another embodiment, the weight component 110 may also be free floating within the cavity and operable to move vertically and horizontally within the internal cavity 106. For example, the weight component 110 may be sized to tilt in a vertical and horizontal motion within the internal cavity 106 in response to movement of the puck 100.

A first annular outer ring 512 may be formed on a top surface of the first portion 102. Similarly, the top surface of the second portion 104 also may form a second annular outer ring 514. The annular outer rings 512, 514 may comprise the same material as the first and second portions or may comprise a deformable material such as rubber. The annular outer rings 512, 514 limit the surface area of the puck 100 that contacts the playing surface, allowing better sliding motion and less friction.

Figure 6:
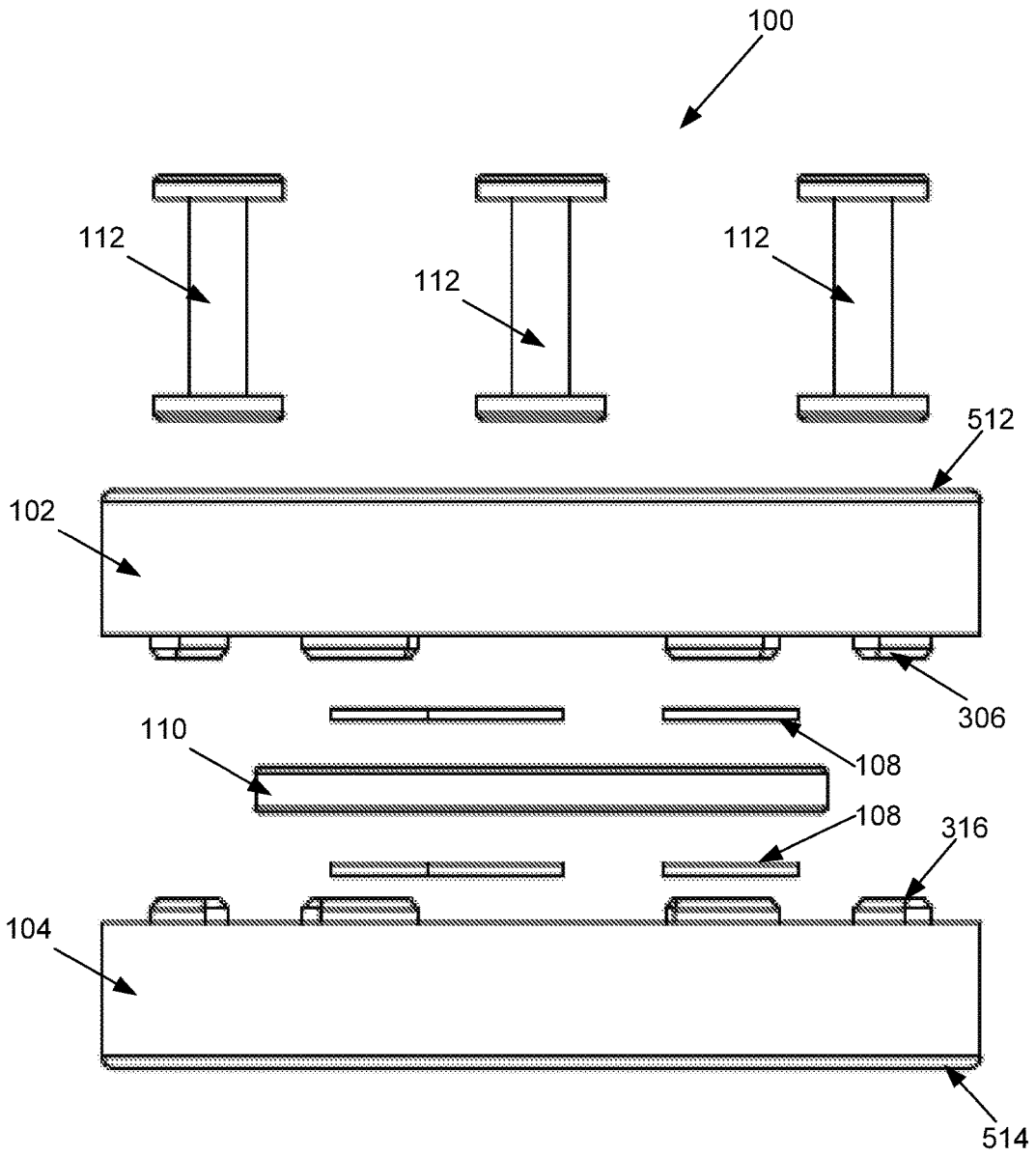
FIG. 6 illustrates a side view of an exemplary embodiment of the components of the puck.

FIG. 6 illustrates a side view of an exemplary embodiment of the components of the puck 100. The first portion 102 includes a plurality of protrusions 306 that fit within corresponding slots 318 of the second portion 104. The first portion 102 also includes the first annular outer ring 512 formed on the top surface. Similarly, the second portion 104 includes a plurality of protrusions 316 that fit within corresponding slots 308 of the first portion 102. The second portion 104 also includes the second annular outer ring 514 formed on its top surface. A plurality of fasteners 112, such as the rivets shown, securely attach the first portion 102 and the second portion 104 to prevent movement relative to each other.

The weight component 110 is positioned within the internal cavity 106 formed by the first portion 102 and the second portion 104. One or more energy absorbing components 108 are positioned between the first portion 102 and the weight component 110 within the internal cavity 106. One or more other energy absorbing components 108 are positioned between the second portion 104 and the weight component 110 within the internal cavity.

The weight component 110 generates a downward force on the puck 100 and helps prevent bouncing from rough playing surfaces, such as asphalt, concrete, and the like. This force helps to prevent the puck 100 from bouncing and to remain horizontal along the ground, e.g. when the puck 100 hits a bump or a player hits a slap shot or when tossed to the playing surface. The energy absorbing components 108 help to absorb or cushion movements of the weight component 110 within the internal cavity 106. The weight component 110 and the energy absorbing components 108 thus increase the likelihood that the puck 100 maintains a horizontal position with respect to the playing surface.

Second Embodiment

Figure 7:
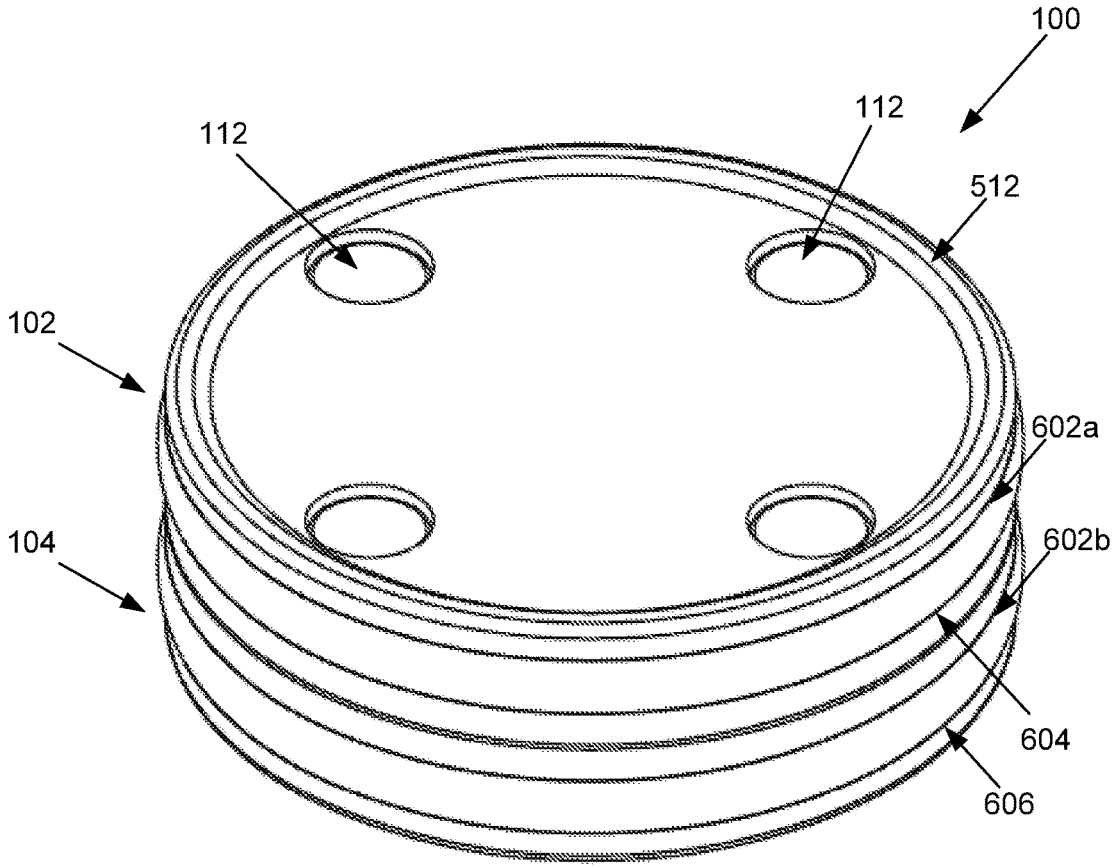
FIG. 7 illustrates an elevational view of another exemplary embodiment of the puck.

FIG. 7 illustrates an elevational view of another exemplary embodiment of the puck 100. In this embodiment, one or more elastic bands 602 are included on a perimeter of the puck 100. For example, a first elastic band 602*a* may be positioned on a first perimeter 604 of the first portion 102 and a second elastic band 602*b* may be positioned on a second perimeter 606 of the second portion 104. The elastic bands 602 assist the puck 100 in bouncing from obstacles and may also increase durability of the puck 100.

Figure 8:
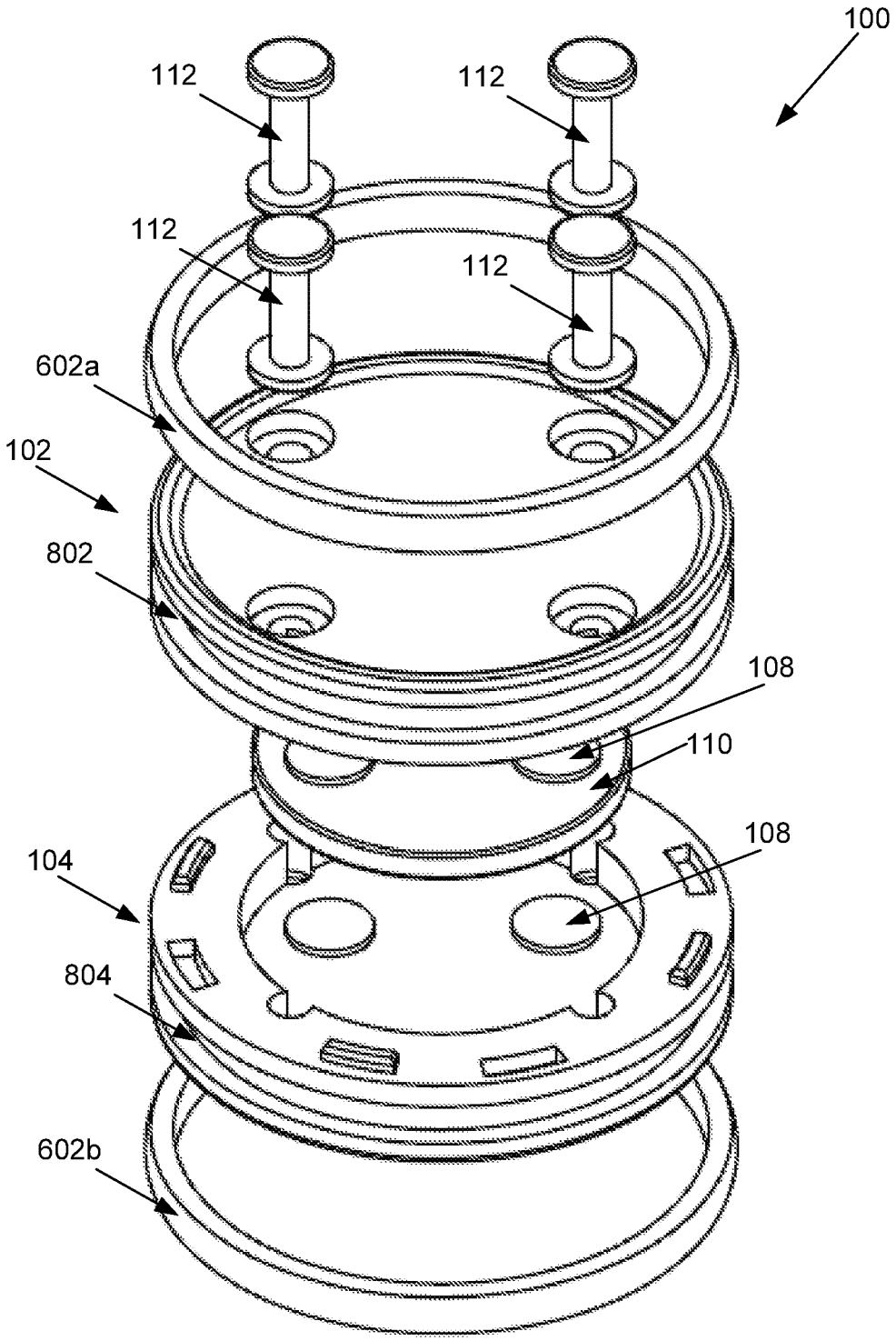
FIG. 8 illustrates an elevational view of an exemplary embodiment of components of the puck with one or more elastic bands.

FIG. 8 illustrates an elevational view of an exemplary embodiment of components of the puck 100 with one or more elastic bands 602. In an embodiment, the first portion 102 includes a first groove 802 in which the first elastic band 602*a* may be positioned. Similarly, the second portion 104 includes a second groove 804 in which the second elastic band 602*b* may be positioned.

As may be used herein, the term "operable to" or "configurable to" indicates that an element includes one or more of material, shape and size to perform one or more of the described or necessary corresponding functions and may further include inferred coupling to one or more other components to perform the described or necessary corresponding functions. As may also be used herein, the term(s) "coupled", "coupled to", "connected to" and/or "connecting" or "interconnecting" includes direct connection or link between components and/or indirect connection between components via an intervening item (e.g., an item includes, but is not limited to, a component, an element, a fastener, etc.).

As may be used herein, the terms "substantially" and "approximately" provides an industry-accepted tolerance for its corresponding term and/or relativity between items. Such relativity between items ranges from a difference of a few percent to magnitude differences.

The various features of the disclosure described herein can be implemented in different systems and devices without departing from the disclosure. It should be noted that the foregoing aspects of the disclosure are merely examples and are not to be construed as limiting the disclosure. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

In the foregoing specification, certain representative aspects of the embodiments have been described with reference to specific examples. Various modifications and changes may be made, however, without departing from the scope of the present invention as set forth in the claims. The specification and figures are illustrative, rather than restrictive, and modifications are intended to be included within the scope of the claims. Accordingly, the scope of the claims should not be limited by the embodiments described herein. For example, the components and/or elements recited in any apparatus claims may be assembled or otherwise operationally configured in a variety of permutations and are accordingly not limited to the specific configuration recited in the claims.

Furthermore, certain benefits, advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a nonexclusive inclusion, such that a process, method, article, composition or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

Moreover, reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is intended to be construed under the provisions of 35 U.S.C. § 112(f) as a "means-plus-function" type element, unless the element is expressly recited using the phrase "means for" or, in the case of a method claim, the element is recited using the phrase "step for."

What is claimed is:

1. A puck, comprising:

a main body having a generally cylindrical shape and forming an internal cavity;

at least one weight component positioned within the internal cavity, wherein the weight component has a substantial mass density; and one or more energy absorbing components attached to the main body within the internal cavity, wherein the weight component is sized to tilt in a vertical and horizontal motion and deform the one or more energy absorbing components within the internal cavity in response to movement of the puck.

2. The puck of claim 1, wherein the main body includes at least a first portion and a second portion securely attached to form the main body.

3. The puck of claim 2, further comprising:

a plurality of fasteners to securely attach the first portion and the second portion, wherein the fasteners extend through first openings formed in the first portion and through second openings formed in the second portion.

4. The puck of claim 1, wherein the weight component includes a material having a mass density substantially greater than a mass density of a material of the main body.

5. A puck, comprising:

a main body having a generally cylindrical shape and forming an internal cavity;

at least one weight component positioned within the internal cavity, wherein the weight component has a substantial mass density; and one or more energy absorbing components attached to the main body within the internal cavity, wherein the weight component is sized to extend across a majority of the internal cavity and wherein the internal cavity has a diameter that is at least half the diameter of the puck.

6. The puck of claim 5, wherein the weight component has a diameter that is approximately 0.1% to 5% less than a diameter of the internal cavity.

7. The puck of claim 6, wherein the weight component has a weight that is at least 20% or more than the total weight of the puck.

8. A puck, comprising:

a main body having a first portion and a second portion securely attached to form a generally cylindrical shape with an internal cavity, wherein the internal cavity has a diameter that is at least half the diameter of the main body of the puck;

one or more energy absorbing components positioned within the internal cavity and attached to the main body; and a weight component positioned adjacent to the one or more energy absorbing components within the internal cavity, wherein the weight component is sized to move in at least one direction and deform the one or more energy absorbing components within the internal cavity in response to movement of the puck.

9. The puck of claim 8, wherein the weight component includes material having a mass density substantially greater than a mass density of material of the main body.

10. The puck of claim 8, wherein the weight component is sized to extend across a majority of the internal cavity.

11. The puck of claim 10, wherein the weight component has a diameter that is approximately 0.1% to 5% less than a diameter of the internal cavity.

12. The puck of claim 11, wherein the weight component has a weight that is at least 25% or more than the total weight of the puck.

13. The puck of claim 8, wherein the first portion includes:

a first peripheral wall; and one or more protrusions extending from the peripheral wall.

14. The puck of claim 13, wherein the second portion includes:

a second peripheral wall; and one or more corresponding slots shaped to fit the one or more protrusions of the first portion.

15. The puck of claim 14, wherein the one or more protrusions extending from the peripheral wall have a length greater than a depth of the one or more corresponding slots of the second portion to form a slit between the first portion and the second portion.

16. The puck of claim 8, wherein the weight component has a weight that is at least 20% or more than the total weight of the puck.

17. The puck of claim 8, wherein the weight component has a weight that is at least 50% or more than the total weight of the puck.

18. A puck, comprising:

a main body having a generally cylindrical shape and forming an internal cavity;

at least one weight component contained within the internal cavity; and one or more energy absorbing components attached to the main body within the internal cavity, wherein the weight component is configured to move within the internal cavity and deform the one or more energy absorbing components in response to movement of the puck.

19. The puck of claim 18, wherein a the diameter of the weight component is less than the diameter of the internal cavity such that the weight component is contained entirely within the internal cavity.

20. The puck of claim 18, wherein the weight component is sized to extend across a majority of the internal cavity.

* * * * *